US006252356B1

(12) United States Patent
Tanabe et al.

(10) Patent No.: US 6,252,356 B1
(45) Date of Patent: Jun. 26, 2001

(54) DISPERSED MULTICOLOR ELECTROLUMINESCENT LAMP AND ELECTROLUMINESCENT LAMP UNIT EMPLOYING THEREOF

(75) Inventors: Koji Tanabe; Naohiro Nishioka; Yosuke Chikahisa, all of Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/428,754

(22) Filed: Oct. 28, 1999

(30) Foreign Application Priority Data

Oct. 28, 1998 (JP) ..... 10-306615

(51) Int. Cl.[7] ..... G09G 3/10

(52) U.S. Cl. ..... 315/169.3; 313/503; 313/506; 313/510

(58) Field of Search ..... 315/169.3, 307, 315/200 A; 313/502, 503, 510, 506, 509, 463, 496; 428/209, 195, 690, 917

(56) References Cited

U.S. PATENT DOCUMENTS

| | | | |
|---|---|---|---|
| 4,155,030 | 5/1979 | Chang | 315/169.3 |
| 4,689,522 | 8/1987 | Robertson | 313/506 |
| 4,777,402 | 10/1988 | Mitsumori | 313/509 |
| 5,047,686 | 9/1991 | Robertson | 313/503 |
| 5,156,924 | 10/1992 | Taniguchi et al. | 428/690 |
| 5,294,870 | 3/1994 | Tang et al. | 313/504 |
| 5,346,776 | 9/1994 | Taniguchi et al. | 428/690 |
| 5,598,058 * | 1/1997 | LaPointe | 313/503 |
| 5,693,428 * | 12/1997 | Fujii et al. | 428/690 |
| 5,773,130 | 6/1998 | So et al. | 428/195 |
| 5,792,561 | 8/1998 | Whang et al. | 428/457 |
| 5,909,081 | 6/1999 | Eida et al. | 313/504 |

FOREIGN PATENT DOCUMENTS

05094243 * 4/1993 (JP) .

OTHER PUBLICATIONS

European Search Report, application No. EP 99 12 1080, dated Jan. 22, 2001.

* cited by examiner

*Primary Examiner*—Haissa Philogene
(74) *Attorney, Agent, or Firm*—Ratner & Prestia

(57) ABSTRACT

A set of a transparent electrode layer and a luminescent layer in which phosphor particles are dispersed are formed on a transparent resin film, and this set is formed layer by layer to create more than one luminescent layer. One or more luminescent layers are divided into multiple luminescent color regions. Or, the transparent electrode layer is electrically separated into two or more regions. This configuration enables the display of multiple patterns in multiple luminescent colors using one dispersed EL lamp. Accordingly, the multicolor EL lamp, which is aesthetically appealing as well as good visibility, can be provided for a display unit of a range of electronic equipment and backlight for LCDs.

24 Claims, 5 Drawing Sheets

DISPERSED MULTICOLOR ELECTROLUMINESCENT LAMP AND ELECTROLUMINESCENT LAMP UNIT EMPLOYING THEREOF

FIELD OF THE INVENTION

The present invention relates to the field of dispersed multicolor electroluminescent (EL) lamps employed as backlights of liquid crystal displays and switch keys in a variety of small mobile equipment, and more particularly to dispersed multicolor EL lamps and EL lamp units employing thereof which not only satisfy practical functions such as visibility but also are aesthetically appealing.

BACKGROUND OF THE INVENTION

A conventional dispersed multicolor EL lamp is described using its sectional view in FIG. 9. In FIG. 9, the thickness dimension is magnified for illustrative purposes.

In FIG. 9, indium tin oxide, for example, is deposited on a transparent resin film 1 using a deposition method such as vacuum sputtering to form a transparent electrode 2. Then a phosphor layer 3 is formed by dispersing phosphor particles such as zinc sulfide doped with copper in a resin with high dielectric constant such as cyanic resin or fluororubber resin. A dielectric layer 4 is made of the same synthetic resin system as the phosphor layer 3 in which ferroelectric powder such as barium titanate is dispersed. A back electrode layer 5 is made of silver resin system or carbon resin system paste. An insulative cover resist 6, followed by external electrodes 7A and 7B are then formed.

When multicolor text or graphics are displayed using the above conventional EL lamp, the text or graphics are directly drawn onto the surface of the transparent insulative film 1 using optically transmissive color paint; or a sheet on which text or graphics are drawn with optically transmissive color paint is attached to the transparent insulative film 1. Alternatively, the luminescent color of the phosphor layer 3 is partially changed to match the text or graphics.

In the above conventional dispersed multicolor EL lamps, however, only one type of text or graphics can be displayed.

SUMMARY OF THE INVENTION

In the dispersed multicolor EL lamp in accordance with an exemplary embodiment of the present invention, a first transparent electrode layer is formed on a transparent resin film, and then a first luminescent layer at least containing a phosphor layer in which phosphor powder is dispersed is formed. Then, a transparent electrode layer and luminescent layer are formed layer by layer as a set to form N (N is an integer of $N \geqq 2$) transparent electrode layers and N luminescent layers. One or more layers in the first to Nth luminescent layers are divided into multiple luminescent color regions for the required text or graphics in the same luminescent layer. A back electrode layer is then formed on the Nth luminescent layer.

The above configuration enables the display of multiple text and graphics in multiple luminescent colors using a single dispersed EL lamp.

In the dispersed multicolor EL lamp in accordance with an exemplary embodiment of the present invention, one or more layers in the first to Nth luminescent layers which are divided into multiple luminescent color regions show an almost colorless monocolor in the same luminescent layer when they are not illuminated, but emit multiple luminescent colors when they are illuminated. When the first to Nth luminescent layers are illuminated independently, multiple divided regions are illuminated in multiple luminescent colors without mutually affecting the coloring of each luminescent layer.

Also in the dispersed multicolor EL lamp in accordance with an exemplary embodiment of the present invention, one or more layers in the first to Nth transparent electrode layers or back electrode layer are electrically separated into two or more regions in the same transparent electrode layer or back electrode layer. This makes it possible to illuminate each divided region of the first to Nth luminescent layers in more than one luminescent color.

Also in the dispersed multicolor EL lamp in accordance with an exemplary embodiment of the present invention, each of the first to (N−1)th luminescent layers is formed of two layers. The first layer is a phosphor layer in which phosphor particles are dispersed. The second layer is formed of a light transmissive insulation layer with higher dielectric constant than that of the first layer. This enables even higher luminance to be achieved when any of the first to (N−1)th luminescent layers are illuminated.

In the dispersed multicolor El lamp in accordance with an exemplary embodiment of the present invention, the Nth luminescent layer is practically formed of two layers. The first layer is a phosphor layer in which phosphor particles are dispersed. The second layer is formed of a white insulation layer with higher dielectric constant than that of the first layer. This makes it possible to achieve even higher luminance when the Nth luminescent layer is illuminated.

Furthermore, in the dispersed multicolor EL lamp in accordance with an exemplary embodiment of the present invention, transparent electrode layers at least other than the first transparent electrode layer are formed of light-transmissive conductive paste with sheet resistance of 50 k or less by printing and drying transparent synthetic resin in which conductive indium tin oxide powder is dispersed. This facilitates the manufacture of the transparent electrode layer, such as by screen printing, at low cost.

Still furthermore, in the dispersed multicolor EL lamp in accordance with an exemplary embodiment of the present invention, the light-transmissive conductive paste for transparent electrode layers may be colored. This allows the overall luminescent color of each of the first to Nth luminescent layers to be changed.

In an EL lamp unit in accordance with an exemplary embodiment of the present invention, a microcomputer is employed to control the turning on and off and flashing of the first to Nth luminescent layers of the dispersed multicolor EL lamp separately or in combination. This makes it possible to automatically turn on, turn off, or flash each of the first to Nth luminescent layers independently or in combination in accordance with predetermined conditions.

Furthermore, in the EL lamp unit in accordance with an exemplary embodiment of the present invention, the microcomputer controls each of the electrically separated electrodes in the first to Nth transparent electrode layers and back electrode layer to automatically apply, shut, or intermittently apply voltage to each of the electrode layers electrically separated into multiple regions independently or in combination. This makes it possible to automatically turn on, turn off, or flash each of divided regions in the first to Nth luminescent layers corresponding to electrically separated electrode layers in the first to Nth transparent electrode layers and back electrode layer independently or in combination, in accordance with predetermined conditions.

DESCRIPTION OF THE PREFERRED EMBODIMENTS

First Exemplary Embodiment

A first exemplary embodiment of the present invention is described with reference to FIGS. 1 to 4. Components having the same configuration as those of the prior art are given the same numbers, and thus their detailed explanation is omitted here.

Figure 1:
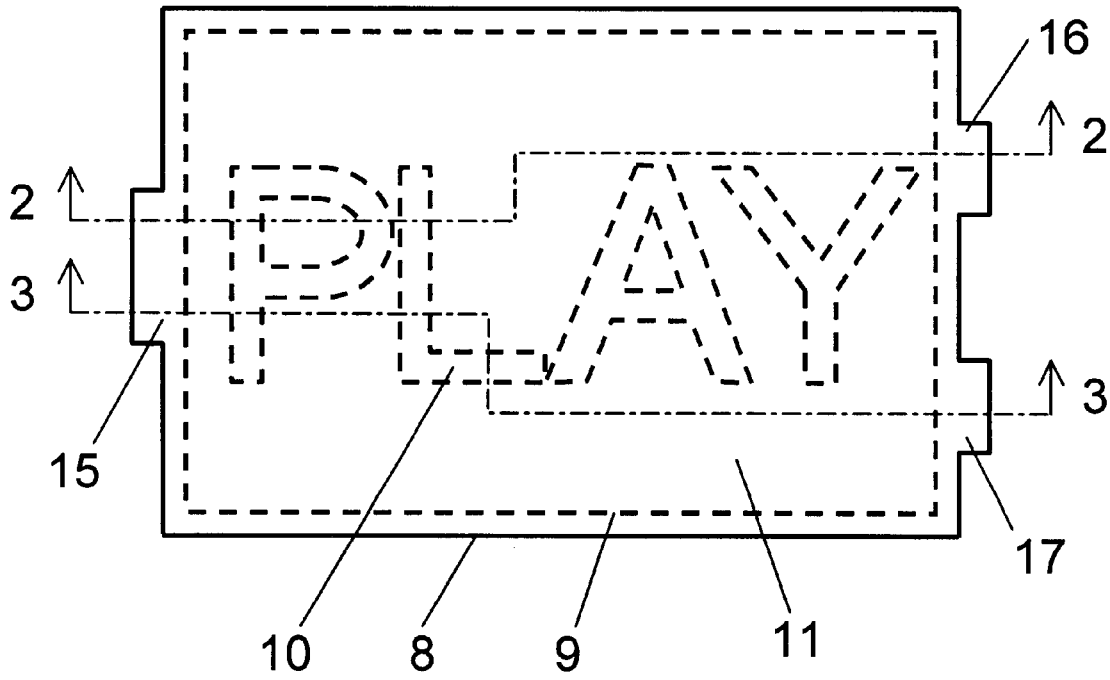
FIG. 1 is a plan view of a dispersed multicolor EL lamp, displaying text, in accordance with a first exemplary embodiment of the present invention.
Figure 2:
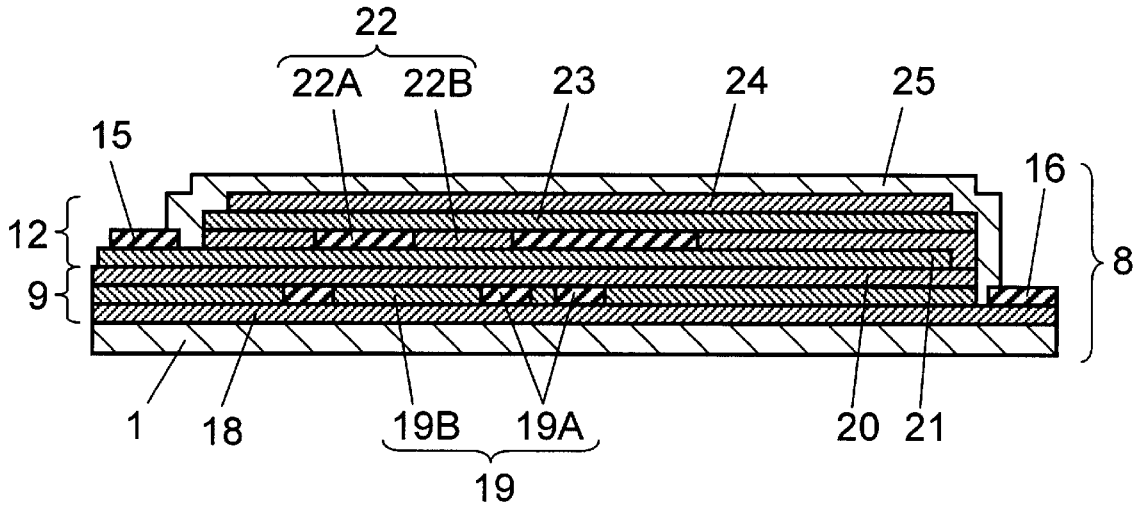
FIG. 2 is a sectional view taken along a line 2—2 in FIG. 1.
Figure 3:
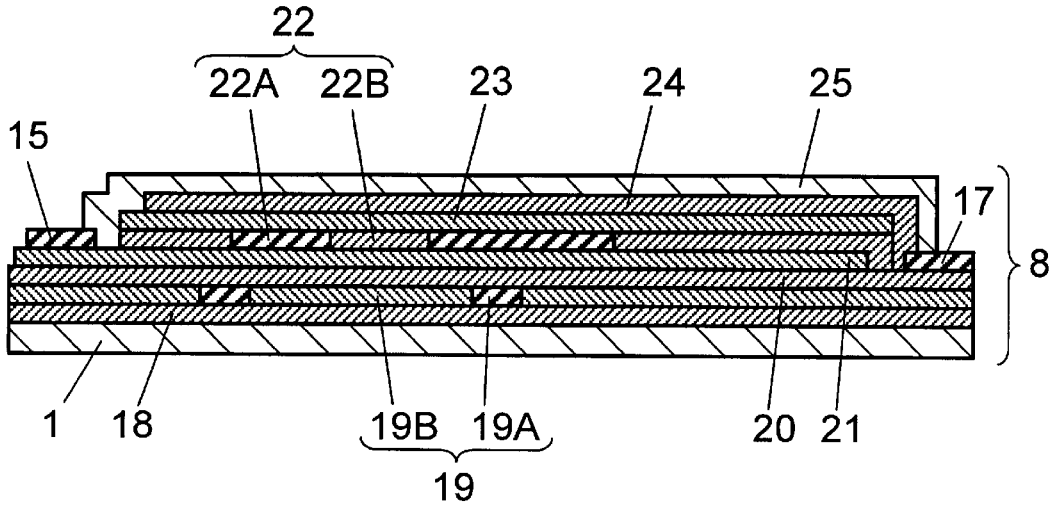
FIG. 3 is a sectional view taken along a line 3—3 in FIG. 1.
Figure 4:
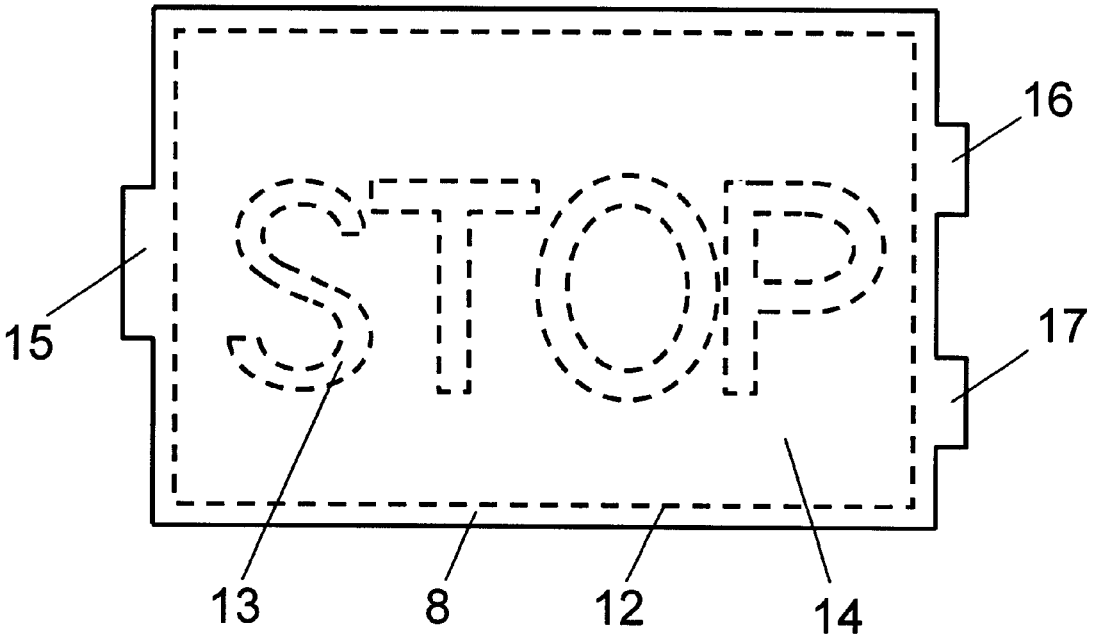
FIG. 4 is a front view of the dispersed multicolor EL lamp, displaying another text different from that in FIG. 1, in accordance with the first exemplary embodiment of the present invention.

FIG. 1 shows a plan view of a dispersed multicolor electroluminescent lamp (hereafter referred to as an EL lamp) in accordance with the first exemplary embodiment of the present invention. FIG. 2 shows a sectional view taken along a line 2—2 in FIG. 1. FIG. 3 shows a sectional view taken along a line 3—3 in FIG. 1. FIG. 4 shows a front view of the dispersed multicolor EL lamp displaying another text different from that in FIG. 1. A light-emitter of an EL lamp 8 of the present invention consists of the lamination of a first light-emitter 9 and second light-emitter 12. Looking at the plan view in FIG. 1, the first light-emitter 9 includes a text light-emitter 10 for "PLAY" and background light-emitter 11. The second light-emitter 12 includes a text light-emitter 13 for "STOP" and background light-emitter 14. Looking at its sectional view in FIG. 2, the first light-emitter 9 includes a first luminescent layer and first transparent electrode layer 18. The first luminescent layer includes a first phosphor layer 19 and first dielectric layer 20. A part of the first phosphor layer 19 corresponding to the text light-emitter 10 is 19A, and a part of the first phosphor layer 19 corresponding to the background light-emitter 11 is 19B. The second light-emitter 12 includes a second luminescent layer, a second transparent electrode layer 21, and a back electrode layer 24. The second luminescent layer includes the second phosphor layer 22 and second dielectric layer 23. A part of the second phosphor layer 22 corresponding to the text light-emitter 13 is 22A, and a part of the second phosphor layer 22 corresponding to the background light-emitter 14 is 22B. Each of the above layers is protected by an insulation layer 25. The second transparent electrode layer 21, first transparent electrode layer 18, and back electrode layer 24 are respectively connected to the external electrodes 15, 16, and 17.

In FIGS. 2 and 3, the part 19A of the first phosphor layer 19 corresponding to the text light-emitter 10 and the part 19B corresponding to the background light-emitter 11 consist of a phosphor with different luminescent color. The part 22A of the second phosphor layer 22 corresponding to the text light-emitter 13 and the part 22B corresponding to the background light-emitter 14 also consist of a phosphor with different luminescent color. When an AC electric field is applied between the external electrodes 15 and 16 to illuminate the first luminescent layer, the text light-emitter 10 for "PLAY" and its background light-emitter 11 in FIG. 1 are displayed in different luminescent colors. When an AC electric field is applied between external electrodes 15 and 17 to illuminate the second luminescent layer, the text light-emitter 13 for "STOP" and its background light-emitter 14 in FIG. 4 are displayed in different luminescent colors.

In this exemplary embodiment, each of the transparent electrode layers 18 and 21, and back electrode layer 24 are uniformly formed on the entire EL light-emitting regions , and each phosphor layer is divided into multiple luminescent color regions in the same phosphor layer.

In the above configuration, a transparent conductive film pre-deposited on a polyester film by sputtering or electron beam evaporation is employed as the first transparent electrode layer 18. For the second transparent electrode layer 21, a light transmissive sheet which is a conductive paste with sheet resistance of 50 kΩ or below made by dispersing indium tin oxide dendrite powder in polyester resin, epoxy resin, acrylic resin, phenoxy resin, fluororubber resin, or the like is employed. For the first phosphor layer 19 and second phosphor layer 22, paste is made by dispersing EL phosphor powder with different luminescent colors for the text and background in resin with high dielectric constant such as cyano ethyl cellulose resin, cyano ethyl pullulan resin, or fluororubber resin containing fluorovinylidine. For the first dielectric layer 20, milky-white optically transmissive paste is made by dispersing a small amount of ferroelectric powder, typically of barium titanate, in the same resin system as the phosphor layer paste. For the second dielectric layer 23, paste which reflects white light is made by dispersing ferroelectric powder, typically of barium titanate, in the same resin system as the phosphor layer paste. For the back electrode layer 24 and external electrodes 15, 16, and 17, silver resin paste or carbon resin paste which is normally used for membrane switches is employed. For the insulation layer 25, electrically insulating paste typically of a polyester system, urethane system, or epoxy system is employed. The above pastes for each layer are printed into a predetermined pattern, typically by screen printing, and then dried to form each layer.

The first transparent electrode layer 18 may also be formed by screen printing the same material as the second transparent electrode layer 21.

As described above, in the first exemplary embodiment, the first luminescent layer is formed of the first phosphor layer 19 and first dielectric layers 20 and the second luminescent layer are formed of the second phosphor layer 22 and second dielectric layer 23. By configuring the dielectric layers 20 and 23 with materials having a higher dielectric constant than that of the phosphor layers 19 and 22, voltage can be more effectively applied to the phosphor than if configuring the luminescent layer only with the phosphor layer, thus achieving higher luminance light emissions.

The first and second phosphor layers may also be colored by adding phosphor dye or phosphor pigment to both pastes. This makes it possible to achieve luminescent color that is different from the natural color of the phosphor.

For the second phosphor layer, phosphor dye or phosphor pigment may be added to the phosphor layer paste for coloring, as well as EL phosphor, when adjusting the luminescent color of the text and background. Addition of phosphor dye or phosphor pigment is not apparent from the light-emitting side when the EL lamp is not turned on. At the same time, there is less color interference when the first phosphor layer is lighted.

In the first exemplary embodiment, the luminescent layer is made of two layers, i.e., the first and second luminescent layers. It is naturally possible to laminate three or more layers. In general, N layers (N is a positive integer) of the luminescent layer may be laminated by providing a transparent electrodes in-between.

In the first exemplary embodiment, each phosphor layer is divided into two luminescent color regions in the same phosphor layer. It may also be divided into three or more, in general to M (M is an integer of $N \geqq 2$) luminescent color regions.

In the first exemplary embodiment, the external electrodes 15, 16 and 17 are disposed on opposite ends of the EL light-emitting region. It is apparent that each external electrode may also be disposed on any end independently or all together.

As described above, the dispersed EL lamp in the first exemplary embodiment enables the display of multiple indications by emitting multiple colors from the same light-emitting face.

Second Exemplary Embodiment

Points that differ in a dispersed multicolor electroluminescent (EL) lamp in accordance with the second exemplary embodiment of the present invention from the first exemplary embodiment are as follows. The second transparent electrode layer and back electrode layer are divided into two regions, and an external electrode is provided for each divided region.

Figure 5:
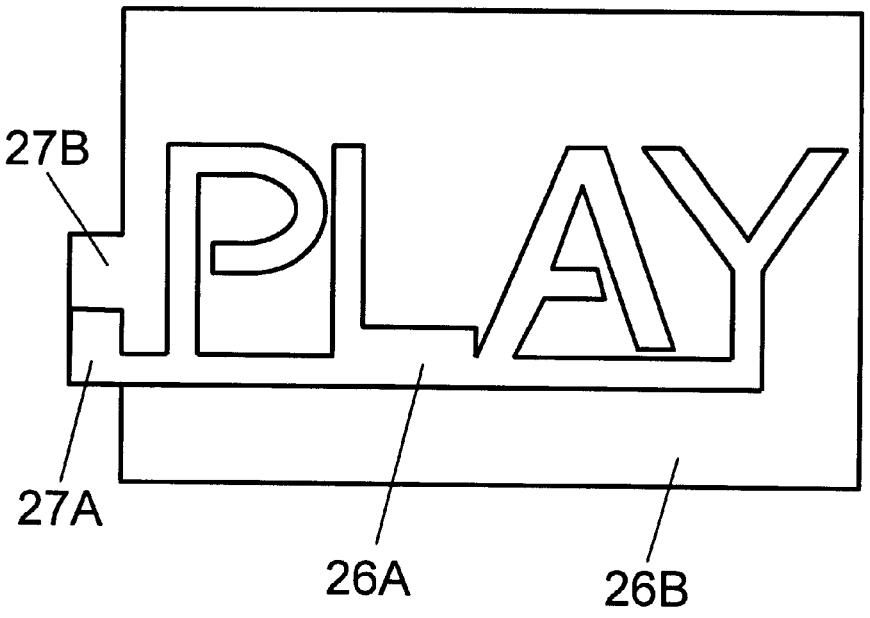
FIG. 5 is a plan view of a second transparent electrode layer of a dispersed multicolor EL lamp in accordance with a second exemplary embodiment of the present invention.
Figure 6:
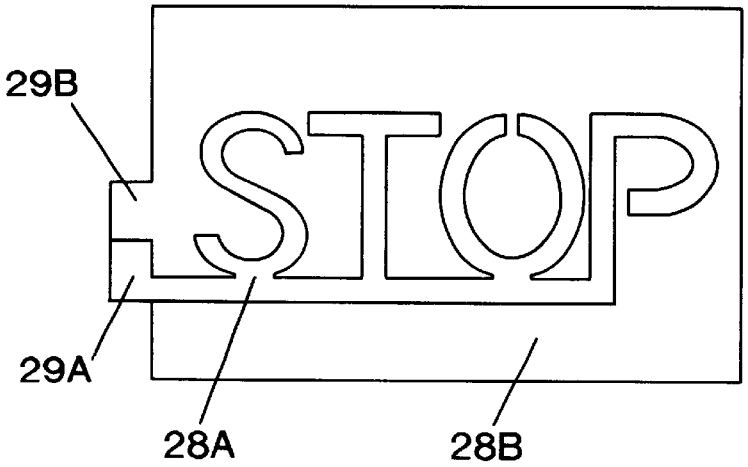
FIG. 6 is a plan view of a back electrode layer of the dispersed multicolor EL lamp in accordance with the second exemplary embodiment of the present invention.
Figure 7:
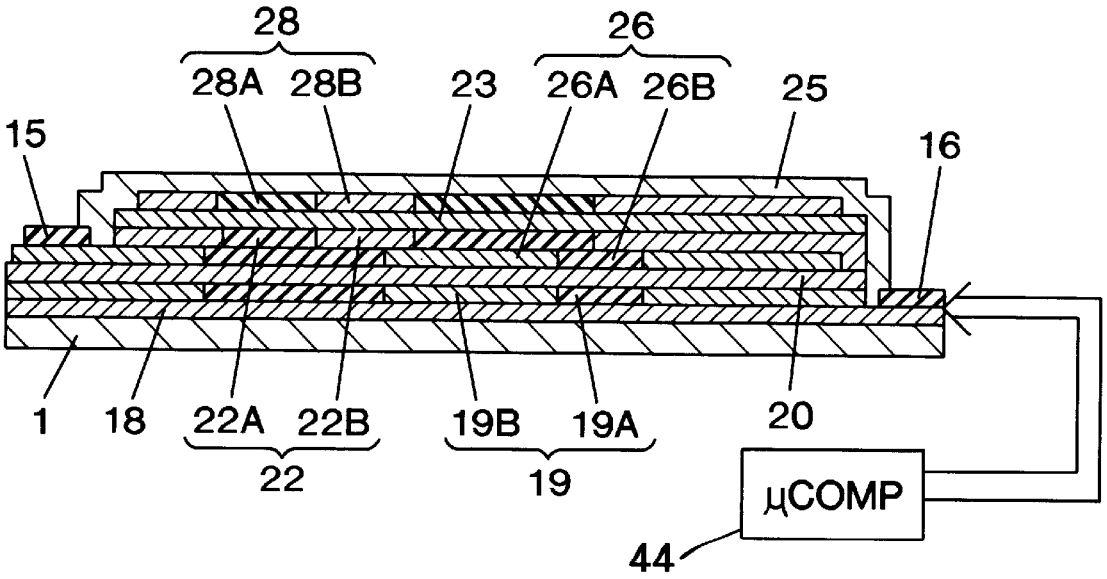
FIG. 7 is a sectional view of the dispersed multicolor EL lamp in accordance with the second exemplary embodiment of the present invention.

FIG. 5 shows a plan view of the second transparent electrode layer of the dispersed multicolor EL lamp in the second exemplary embodiment. FIG. 6 is a plan view of the back electrode layer. FIGS. 5 and 6 show that the second transparent electrode layer and the back electrode layer in the first exemplary embodiment are divided into two regions. FIG. 7 shows a sectional view of the dispersed multicolor EL lamp in the second exemplary embodiment, which corresponds to FIG. 2 illustrating the first exemplary embodiment.

In FIG. 5, a text electrode 26A is a region of a second transparent electrode layer 26 formed at a position corresponding to the text light-emitter 10 for "PLAY" in FIG. 1. A background electrode 26B is a region of the second transparent electrode layer 26 corresponding to the background light-emitter 11. An external electrode 27A is an electrode for the text electrode 26A, and an external electrode 27B is an electrode for the background electrode 26B. In FIG. 6, a text electrode 28A is a region of a back electrode layer 28 which is formed in a position corresponding to the text light-emitter 13 for "STOP" in FIG. 4. A background electrode 28B is a region of the back electrode layer 28 corresponding to the background light-emitter 14. An external electrode 29A is an electrode for the text electrode 28A, and an external electrode 29B is an electrode for the background electrode 28B. The first transparent electrode layer is uniformly formed on the entire face.

The materials used for each layer of the EL lamp in the second exemplary embodiment is the same as that used in the first exemplary embodiment.

In the second exemplary embodiment, as described below, different indications may be displayed by changing the combination of selected transparent electrode layers and the back electrode layer when applying voltage to each transparent electrode layer and back electrode layer through each external electrode.

First, when voltage is applied between the first transparent electrode layer 18 and the text electrode 26A of the second transparent electrode layer 26, i.e. voltage is applied between the external electrode 16 and external electrode 27A, the lamp may be controlled to illuminate only the text light-emitter 10 for "PLAY" without illuminating the background light-emitter 11. In the same way, when voltage is applied between the first transparent electrode layer 18 and the background electrode 26B of the second transparent electrode layer 26, i.e. voltage is applied between the external electrode 16 and external electrode 27B, the lamp may be controlled to illuminate only the background light-emitter 11 for "PLAY" without lighting the text light-emitter 10. When the external electrode 27A and external electrode 27B of the second transparent electrode layer 26 are short circuited, and voltage is applied between the short circuited part and external electrode 16, the text light-emitter 10 for "PLAY" and its background light-emitter 11 are both illuminated simultaneously in different luminescent colors.

In the same way, when the external electrode 27A and external electrode 27B of the second transparent electrode layer 26 are short circuited, and voltage is applied between the short circuited part and the external electrode 29A for the text electrode 28A of the back electrode layer 28, only the text light-emitter 13 for "STOP" is lighted. When the external electrode 27A and external electrode 27B of the second transparent electrode layer 26 are short circuited and voltage is applied between the short circuited part and the external electrode 29B for the background electrode 28B of the back electrode layer 28, only the background light-emitter 14 for "STOP" is lighted. When voltage is applied between a short circuited part of the external electrode 27A and external electrode 27B for the second transparent electrode layer 26 and a short circuited part of the external electrode 29A and external electrode 29B for the back electrode layer 28, the text light-emitter 13 for "STOP" and its background light-emitter 14 are both illuminated simultaneously in different luminescent colors.

As described above, in the second exemplary embodiment, a range of indications which are also aesthetically appealing may be displayed by selecting the transparent electrode layer and back electrode layer to apply voltage to change the display color and background color as well as the display pattern.

For easier understanding, in the second exemplary embodiment, each of the boundary between different luminescent color regions in the first phosphor layer is patterned such that it approximately coincides with the boundary between electrically separated regions in the second transparent electrode layer. Also the boundary between different luminescent color regions in the second phosphor layer approximately coincides with the boundary between electrically separated regions in the back electrode layer. However, the present invention is not limited to this configuration. A boundary between different luminescent color regions in the phosphor layer and a boundary between electrically separated regions in the transparent electrode layer or back electrode layer may be varied to achieve a wider range of indications.

In this exemplary embodiment, EL lamp includes two luminescent layers: the first and second luminescent layers. Three or more luminescent layers may be laminated by providing a transparent electrode in-between, each luminescent layer may be divided into multiple different luminescent color regions, and each transparent electrode layer may be electrically separated into two or more regions.

Third Exemplary Embodiment

Figure 8A:
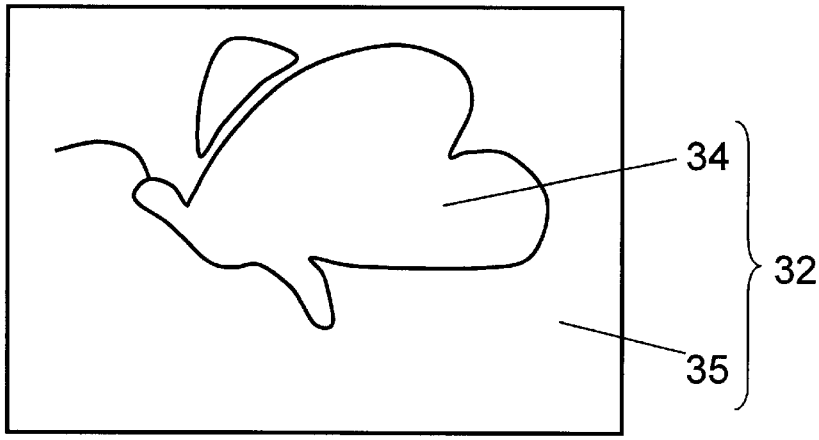
FIG. 8A is a plan view of a first luminescent layer of dispersed multicolor EL lamp in accordance with a third exemplary embodiment of the present invention.
Figure 8B:
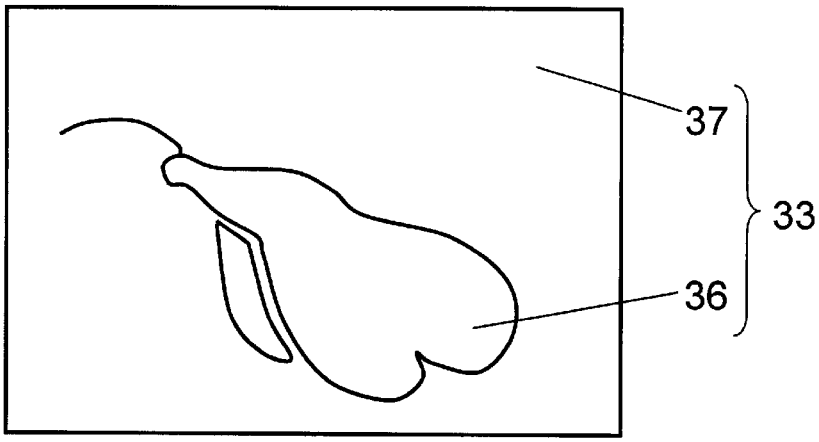
FIG. 8B is a plan view of a second luminescent layer of dispersed multicolor EL lamp in accordance with the third exemplary embodiment of the present invention.
Figure 9:
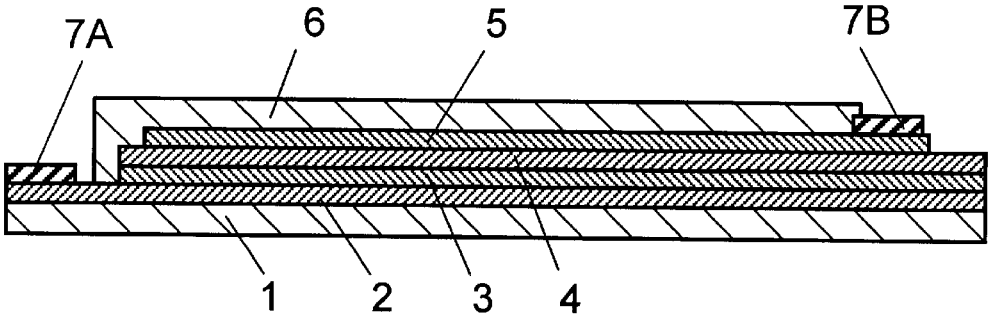
FIG. 9 PRIOR ART
FIG. 9 is a sectional view of a dispersed multicolor EL lamp of the prior art.

FIG. 8A and 8B show top views of flying image patterns of butterflies 34 and 36 in the first luminescent layer 32 and the second luminescent layer 33 respectively in a dispersed multicolor electroluminescent (EL) lamp in a third exemplary embodiment of the present invention. Each luminescent layer is composed of a phosphor layer and a dielectric layer, as described in the previous exemplary embodiments.

In this EL lamp, an orange EL phosphor is used for the butterflies 34 and 36, and green EL phosphor is used for backgrounds 35 and 37 to form the first luminescent layer 32 and second luminescent layer 33 respectively.

Each layer is formed using the same materials as in the first exemplary embodiment.

There are two methods for partially changing the luminescent color of the EL lamp: 1) Changing the luminescent color of the EL phosphor contained in the phosphor layer, and 2) additionally dispersing phosphor dye or phosphor pigment, colored to a different color from the luminescent color of the EL phosphor, in the phosphor layer. The light generated in the second phosphor layer must pass through the first phosphor layer before it is finally emitted from the transparent resin film. Therefore, if the luminescent color of the butterfly part and the background in the first phosphor layer are changed using method 2), it is anxious that the color emitted from the second phosphor layer is affected or interfered by the added phosphor dye or phosphor pigment in the first phosphor layer.

Thus, in the third exemplary embodiment, the luminescent color of each EL phosphor for butterflies 34 and 36 and backgrounds 35 and 37 of the first and second luminescent layers 32 and 33 are respectively changed. With this configuration, both first and second luminescent layers 32 and 33 are virtually colorless when they are not illuminated, so the coloring of the first luminescent layer 32 does not affect the second luminescent layer 33 when only the second luminescent layer 33 is lighted. When the first and second luminescent layers 32 and 33 are lighted independently, the butterflies 34 and 36 are illuminated in orange, and the backgrounds 35 and 37 are illuminated in green.

If the EL lamp of the present invention is configured as an EL circuit unit, controlled by the microcomputer 44 (as shown in FIG. 7), to illuminate the first and second luminescent layers 32 and 33 alternately, the butterfly may be made to appear as if it is flying by alternately turning on the first and second luminescent layers 32 and 33.

It is apparent that the EL lamps described in the first and second exemplary embodiments may also be configured to be controlled by a microcomputer to automatically change, turn on, turn off, or flash the displayed indication by selecting the transparent electrode layer or back electrode layer to which voltage is to be applied.

As described above, the present invention offers a dispersed EL lamp which enables multiple colors to be emitted from the same light-emitting face of a single EL lamp. Furthermore, multiple text or graphics may be displayed independently or simultaneously.

Reference Numerals

1 transparent resin film
2 transparent electrode
3 phosphor layer
4 dielectric layer
5 back electrode layer
6 cover resist
7A, 7B external electrode
8 EL lamp
9 first light-emitter
10, 13 text light-emitter
11, 14 background light-emitter
15, 16, 17, 27A, 27B, 29A, 29B external electrode
18 first transparent electrode layer
19, 32 first phosphor layer
19A, 22A part corresponding to text light-emitters 10 and 13
19B, 22B part corresponding to background light-emitters 11 and
20 first dielectric layer
21, 26 second transparent electrode layer
22, 33 second phosphor layer
23 second dielectric layer
24, 28 back electrode layer
25 insulation layer
26A, 28B text electrode
26B, 28B background electrode
34, 36 butterfly
35, 37 background Reference Numerals

1 transparent resin film
2 transparent electrode
3 phosphor layer
4 dielectric layer
5 back electrode layer
6 cover resist
7A, 7B external electrode
8 EL lamp
9 first light-emitter
10, 13 text light emitter
11, 14 background light-emitter
15, 16, 17, 27A, 27B, 29A, 29B external electrode
18 first transparent electrode layer
19, 32 first phosphor layer
19A, 22A part corresponding to text light-emitters 10 and 13
19B, 22B part corresponding to background light-emitters 11 and 14
20 first dielectric layer
21, 26 second transparent electrode layer
22, 33 second phosphor layer
23 second dielectric layer
24, 28 back electrode layer
25 insulation layer
26A, 28B text electrode
26B, 28B background electrode
34, 36 butterfly
35, 37 background

What is claimed is:

1. A dispersed multicolor electroluminescent lamp comprising:

a transparent substance;

a first of N transparent electrode layers adjacent to said transparent substance;

a first of N luminescent layers adjacent to said first transparent electrode layer, said first luminescent layer containing dispersed phosphor particles;

a second of said N transparent electrode layers adjacent to said first luminescent layer;

a second of said N luminescent layers adjacent to said second transparent electrode layer, said second luminescent layer containing dispersed phosphor particles;

the Nth of said transparent electrode layers adjacent to said (N−1)th of said luminescent layers;

the Nth of said luminescent layers adjacent to said Nth of said transparent electrode layers and said Nth of said luminescent layers containing dispersed phosphor particles; and a back electrode layer adjacent to said Nth of said luminescent layers;

wherein at least one layer of said first to Nth luminescent layers is divided into different luminescent color regions.

2. The dispersed multicolor electroluminescent lamp as defined in claim 1, wherein at least one of said first to Nth transparent electrode layers and said back electrode layer is electrically separated into more than one region.

3. The dispersed multicolor electroluminescent lamp as defined in claim 2, wherein a boundary of said different luminescent color regions in the kth (k is a positive integer between 1 and N) layer of said luminescent layers approximately coincides with a boundary of electrically separated regions in the (k+1)th layer of said transparent electrode layers (when k=N, electrically separated regions in the back electrode layer).

4. An electroluminescent lamp according to claim 2, wherein said electroluminescent lamp is included in a electroluminescent unit employing a microcomputer for automatically controlling the application, shut-off, and intermittent application of voltage to one of single and plurality of electrically separated electrode regions in said first to Nth transparent electrode layers and said back electrode layer in said dispersed multicolor electroluminescent lamp.

5. An electroluminescent lamp according to claim 3, wherein said electroluminescent lamp is included in a electroluminescent unit employing a microcomputer for automatically controlling the application, shut-off, and intermittent application of voltage to one of single and plurality of electrically separated electrode regions in said first to Nth transparent electrode layers and said back electrode layer in said dispersed multicolor electroluminescent lamp.

6. The dispersed multicolor electroluminescent lamp as defined in claim 1, wherein at least one of said first to Nth luminescent layers is divided into more than one luminescent color region in the same said luminescent layer by one of a text and graphics patterns.

7. The dispersed multicolor electroluminescent lamp as defined in claim 1, wherein at least one of said first to Nth luminescent layers divided into more than one luminescent region shows an almost colorless monocolor when it is no illuminated but emits multiple luminescent colors when it is illuminated.

8. The dispersed multicolor electroluminescent lamp as defined in claim 1, wherein said first to (N−1)th luminescent layers are respectively formed of two adjacent layers; a first layer being a phosphor layer in which phosphor particles are dispersed; and a second layer being an optically transmissive insulation layer with higher dielectric constant than said first layer.

9. The dispersed multicolor electroluminescent lamp as defined in claim 1, wherein said Nth luminescent layer is practically formed of two layers; a first layer being a phosphor layer in which phosphor particles are dispersed; and a second layer being a white insulation layer with higher dielectric constant than said first layer.

10. The dispersed multicolor electroluminescent lamp as defined in claim 1, wherein said transparent electrode layers at least other than said first transparent electrode layer are formed by printing and drying optically transmissive conductive paste with a sheet resistance of not greater than 50 k which is made by dispersing conductive indium tin oxide in transparent synthetic resin.

11. The dispersed multicolor electroluminescent lamp as defined in claim 10, wherein said optical transmissive conductive paste is colored.

12. An electroluminescent lamp according to claim 1, wherein said electroluminescent lamp is included in an electroluminescent unit employing a microcomputer for automatically controlling the turning on and off and flashing of one of single and plurality of said first to Nth luminescent layers in said dispersed multicolor electroluminescent lamp.

13. A dispersed multicolor electroluminescent lamp in which a first of N transparent electrode layers and a first of N luminescent layers containing dispersed phosphor particles are laminated on a transparent resin film in this sequence; said N transparent electrode layers and said N luminescent layers being laminated layer by layer up to the Nth transparent electrode layer and then the Nth luminescent layer; one and more of said first to Nth luminescent layers being divided into multiple different luminescent color regions, and a back electrode layer being formed on said Nth luminescent layer.

14. The dispersed multicolor electroluminescent lamp as defined in claim 13, wherein said Nth luminescent layer is practically formed of two layers; a first layer being a phosphor layer in which phosphor particles are dispersed; and a second layer being a white insulation layer with higher dielectric constant than said first layer.

15. The dispersed multicolor electroluminescent lamp as defined in claim 13, wherein at least one of said first to Nth transparent electrode layers and said back electrode layer is electrically separated into more than one region.

16. The dispersed multicolor electroluminescent lamp as defined in claim 15, wherein a boundary of said different luminescent color regions in the kth (k is a positive integer between 1 and N) layer of said luminescent layers approximately coincides with a boundary of electrically separated regions in the (k+1)th layer of said transparent electrode layers (when k=N, electrically separated regions in the back electrode layer).

17. An electroluminescent lamp according to claim 15, wherein said electroluminescent lamp is included in a electroluminescent unit employing a microcomputer for automatically controlling the application, shut-off, and intermittent application of voltage to one of single and plurality of electrically separated electrode regions in said first to Nth transparent electrode layers and said back electrode layer in said dispersed multicolor electroluminescent lamp.

18. An electroluminescent lamp according to claim 16, wherein said electroluminescent lamp is included in a electroluminescent unit employing a microcomputer for automatically controlling the application, shut-off, and intermittent application of voltage to one of single and plurality of electrically separated electrode regions in said first to Nth transparent electrode layers and said back electrode layer in said dispersed multicolor electroluminescent lamp.

19. The dispersed multicolor electroluminescent lamp as defined in claim 13, wherein at least one of said first to Nth luminescent layers divided into more than one luminescent region shows an almost colorless monocolor when it is no illuminated but emits multiple luminescent colors when it is illuminated.

20. An electroluminescent lamp according to claim 13, wherein said electroluminescent lamp is included in an electroluminescent unit employing a microcomputer for automatically controlling the turning on and off and flashing of one of single and plurality of said first to Nth luminescent layers in said dispersed multicolor electroluminescent lamp.

21. The dispersed multicolor electroluminescent lamp as defined in claim 13, wherein at least one of said first to Nth luminescent layers is divided into more than one luminescent color region in the same said luminescent layer by one of a text and graphics patterns.

22. The dispersed multicolor electroluminescent lamp as defined in claim 13, wherein said first to (N−1)th luminescent layers are respectively formed of two adjacent layers; a first layer being a phosphor layer in which phosphor particles are dispersed; and a second layer being an optically transmissive insulation layer with higher dielectric constant than said first layer.

23. The dispersed multicolor electroluminescent lamp as defined in claim 13, wherein said transparent electrode layers at least other than said first transparent electrode layer are formed by printing and drying optically transmissive conductive paste with a sheet resistance of not greater than 50 k which is made by dispersing conductive indium tin oxide in transparent synthetic resin.

24. The dispersed multicolor electroluminescent lamp as defined in claim 23, wherein said optical transmissive conductive paste is colored.

* * * * *